United States Patent [19]

Oulton

[11] Patent Number: 4,540,932

[45] Date of Patent: Sep. 10, 1985

[54] TALK FILTERED POWER SUPPLY

[75] Inventor: David B. Oulton, Dollard des Ormeaux, Canada

[73] Assignee: Pylon Electronic Development Co., Ltd., Nepean, Canada

[21] Appl. No.: 527,365

[22] Filed: Aug. 29, 1983

[30] Foreign Application Priority Data

Sep. 16, 1982 [CA] Canada ..... 411556

[51] Int. Cl.[3] ..... G05F 1/46

[52] U.S. Cl. ..... 323/266; 323/284

[58] Field of Search ..... 323/266, 276, 270, 268, 323/284, 285; 361/18, 87, 93

[56] References Cited

U.S. PATENT DOCUMENTS 3,500,172 3/1970 Eckstein, Jr. ..... 323/270

3,886,410 5/1975 Seer, Jr. ..... 323/276

OTHER PUBLICATIONS

Motorola Semiconductor Circuits Manual, published 1964, pp. 8-2-2 and 8-2-3.

*Primary Examiner*—Peter S. Wong

*Assistant Examiner*—Judson H. Jones

*Attorney, Agent, or Firm*—Wenderoth, Lind & Ponack

[57] ABSTRACT

A DC power supply comprising a pre-regulator having an input connected to a DC supply, a control terminal connected to a reference voltage and an output connected to an input of a three terminal integrated circuit (IC) voltage regulator. The IC regulator has an output terminal for connection to a load and an adjustment terminal connected to a bias voltage, a zener diode being connected between the control terminal and the output of the IC regulator and between the input and output of the IC regulator. The zener diode has a breakdown voltage less than a maximum permissible input-output voltage differential for the IC regulator whereby an excessive load demand tending to increase the input voltage to the IC regulator causes the zener diode to conduct and reduce the voltage on the control terminal of the pre-regulator which thereupon decreases the voltage to the input of the IC regulator.

1 Claim, 1 Drawing Figure

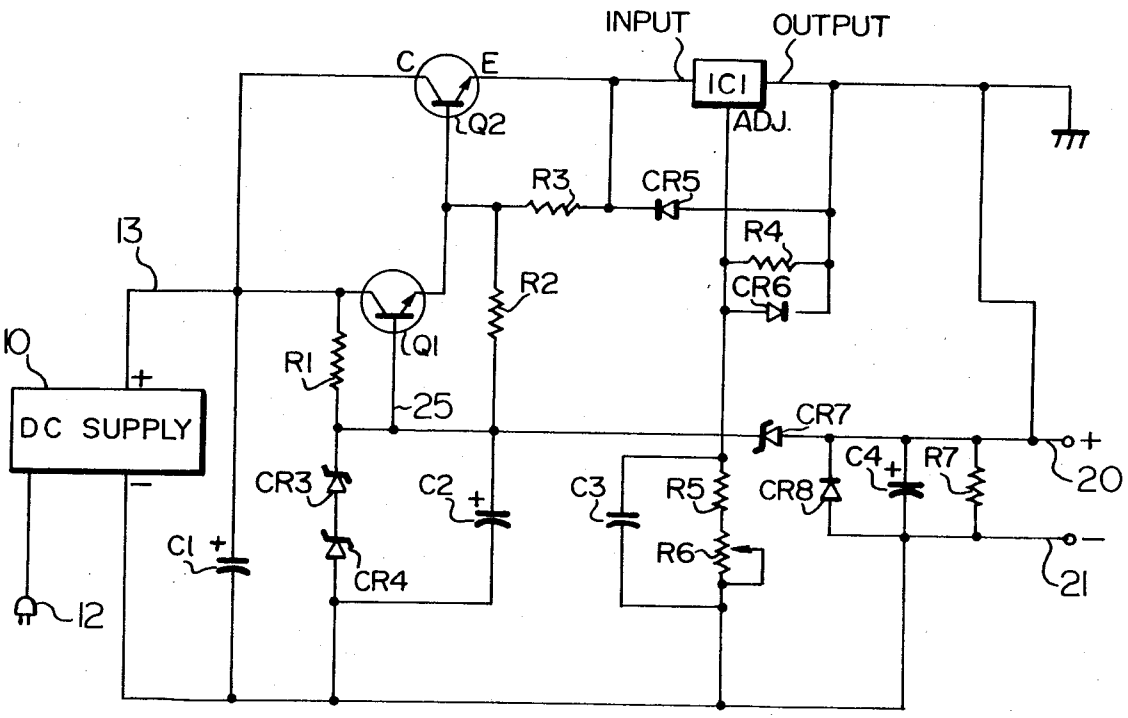
OUTPUT
INPUT
IC1
ADJ.
R4
CR6
CR5
R3
R2
Q2
C
E
Q1
25
R1
CR3
CR4
C2
C3
R5
R6
CR7
CR8
C4
R7
20
21
C1
13
DC SUPPLY
10
12

TALK FILTERED POWER SUPPLY

BACKGROUND OF THE INVENTION

This invention relates to DC power supplies and in particular to a protective arrangement for a three-terminal IC power regulator used in such a DC power supply.

Three terminal adjustable voltage regulators in the form of integrated circuits (IC's) are known, for example the LM117, LM217 and LM317 of National Semiconductor, to name a few. These devices have an input terminal, an output terminal and an adjustment terminal and include built-in protective measures such as current limit, thermal overload protection and safe area protection. External diodes can be used to protect against damage caused by accidental capacitive discharges due to shorting the adjustment pin or output pin. However, they can be damaged or destroyed if the input-output differential exceeds their design limit, e.g. 40 volts.

SUMMARY OF THE INVENTION

The present invention avoids this problem by connecting a zener diode between the output of the IC regulator and the control terminal of a series regulator which has an output connected to the input of the IC regulator. The zener diode is also connected across the input and output of the IC regulator and, if the voltage across the input and output exceeds a given value, which is less than the maximum allowed thereacross, the zener diode begins conducting and causes the series regulator to limit the voltage applied to the input of the IC regulator.

BRIEF DESCRIPTION OF THE DRAWING

The invention will now be further described in conjuction with the accompanying drawing which is a partly block, partly schematic, drawing of a preferred embodiment of the invention.

DESCRIPTION OF THE PREFERRED EMBODIMENT

Referring to the drawing, the circuit according to the invention is powered by a conventional unregulated DC supply 10, here shown having a plug 12 for connection to a mains supply, e.g. 120 V, 60 Hz. The circuit shown has a positive ground and may be used as a talk filtered power supply for a key telephone or other systems requiring an equivalent of a local battery. It can provide batteryless operation or operate as a charger for lead acid batteries.

The positive output 13 of DC supply 10 is connected to the collectors of transistors Q1 and Q2 which are connected in a Darlington configuration and function as a preregulator for the input of IC1 which is a three terminal integrated circuit regulator such as (but not limited to) a National Semiconductor LM117, LM217 or LM317. The voltage at the input of IC1 is normally controlled by the voltage drop across zener diodes CR3 and CR4 plus the base-emitter voltage drops of Q1 and Q2. The base 25 of Q1 is a control input for the preregulator comprising Q1 and Q2; during normal operation its output is set to a predetermined value by zener diodes CR3 and CR4. However, in the event of a short circuit across output terminals 20 and 21, or an excessive load current demand, the voltage across CR7 will exceed its breakdown voltage and it will draw current via resistor R1 and reduce the voltage on the base of Q1, thus reducing the voltage on the input of IC1.

The breakdown voltage of CR7 is less than the maximum input-output voltage differential of IC1.

When the voltage across IC1 decreases to below the breakdown voltage of CR7, the circuit returns to normal operation.

R5, R6 and C3 are used to set the voltage on the adjustment terminal of IC1. C4 and R7 are an output filter. CR5, CR6 and CR8 are conventional protective diodes. C1 is an input filter capacitor. Capacitor C2 provides an AC bypass for the DC voltage to the base of Q1. The resistors R2 and R3 provide a reverse voltage discharge path for Q1 and Q2, respectively.

What I claim as my invention is:

1. A DC power supply comprising a pre-regulator having an input connected to a DC supply, a control terminal connected to a reference voltage and an output connected to an input of a three terminal integrated circuit (IC) voltage regulator, said IC regulator having an output terminal for connection to a load and an adjustment terminal connected to a bias voltage, a zener diode being connected between said control terminal and the output of the IC regulator and between the input and output of the IC regulator, said zener diode having a breakdown voltage less than a maximum permissible input-output voltage differential for the IC regulator whereby an excessive load demand tending to increase the input voltage to the IC regulator causes the zener diode to conduct and reduce the voltage on the control terminal of the preregulator which thereupon decreases the voltage to the input of the IC regulator.

* * * * *